US009507304B2

(12) United States Patent
Umeno

(10) Patent No.: US 9,507,304 B2
(45) Date of Patent: Nov. 29, 2016

(54) IMAGE FORMING APPARATUS HAVING BLOWING SECTION

(71) Applicant: KONICA MINOLTA, INC., Tokyo (JP)

(72) Inventor: Hideyuki Umeno, Sagamihara (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/645,961

(22) Filed: Mar. 12, 2015

(65) Prior Publication Data

US 2015/0268600 A1 Sep. 24, 2015

(30) Foreign Application Priority Data

Mar. 18, 2014 (JP) ..... 2014-054401

(51) Int. Cl.
*G03G 15/20* (2006.01)

(52) U.S. Cl.
CPC ..... *G03G 15/2064* (2013.01); *G03G 15/2017* (2013.01)

(58) Field of Classification Search
CPC ..... G03G 15/025; G03G 15/2067; G03G 21/206
USPC ..... 399/67, 69, 68, 92
See application file for complete search history.

(56) References Cited

U.S. PATENT DOCUMENTS 5,432,593 A * 7/1995 Nishikawa et al. ..... 399/328
2009/0226200 A1* 9/2009 Ando ..... 399/69
2012/0121286 A1* 5/2012 Suzuki ..... 399/67
2013/0094877 A1* 4/2013 Tsuji et al. ..... 399/92
2013/0164015 A1* 6/2013 Kawai et al. ..... 399/69
2013/0279932 A1* 10/2013 Ishigai et al. ..... 399/69
2014/0147161 A1* 5/2014 Matsuno ..... 399/92

FOREIGN PATENT DOCUMENTS

JP 62081682 A * 4/1987
JP 2-103076 A 4/1990
JP H10-213931 A 8/1998
JP 2009-210792 A 9/2009
JP 2011-59636 A 3/2011

OTHER PUBLICATIONS

Office Action dated Mar. 29, 2016 issued in the corresponding Japanese Patent Application No. 2014-054401 and English translation (11 pages).

* cited by examiner

*Primary Examiner* — Billy Lactaoen
*Assistant Examiner* — Arlene Heredia Ocasio
(74) *Attorney, Agent, or Firm* — Buchanan Ingersoll & Rooney PC

(57) ABSTRACT

An image forming apparatus that performs image formation on continuous paper having a toner image formed thereon by making the continuous paper pass through a nip section to fix the toner image to the continuous paper, the nip section being formed by heating at least one of a pair of fixing members and pressure-contacting the fixing members with each other, the apparatus including: a conveyance section which conveys the continuous paper; a blowing section which blows air to the heated fixing member; a pressure-contact separation section which switches the pair of fixing members between a pressure-contacted state and a separated state; and a control section which, after the image formation is finished, stops heating of the fixing member, separates the pair of fixing members with the pressure-contact separation section and blows the air to the heated fixing member with the blowing section.

14 Claims, 7 Drawing Sheets

IMAGE FORMING APPARATUS HAVING BLOWING SECTION

BACKGROUND OF THE INVENTION

1. Field of the Invention

The present invention relates to an image forming apparatus.

2. Description of Related Art

Conventionally, there have been known electrographic type image forming apparatuses each of which develops, with toners, electrostatic latent images formed on photoreceptors to form toner images, transfers the formed toner images onto a sheet, heats and fixes the transferred toner images and thereby form an image on the sheet.

In an electrographic type image forming apparatus, when forming an image on continuous paper (for example, a roll of paper), if the apparatus stops conveying the sheet at the start of image formation (when a fixing temperature increases) and at the end of image formation (when the fixing temperature decreases), a certain part of the continuous paper is heated, and thus, burn and deformation are respectively generated on normal paper and artificial paper.

Thus, by conveying the continuous paper at a low speed until the fixing temperature is raised to a predetermined temperature at the start of image formation, the damage to the continuous paper is reduced while reducing waste by shortening the portion having no image formed, that is, the portion to be wasted. However, in order to decrease the fixing temperature at the end of image formation to a temperature not damaging the continuous paper, a longer time is required compared to the above raising of fixing temperature. Thus, even if the continuous paper is conveyed at a low speed, the portion having no image formed is longer compared to the length thereof when raising the fixing temperature, and more portion is wasted.

Thus, there have been disclosed techniques for controlling a heating roller not to contact the continuous paper which is stopped being conveyed by moving away one of heating rollers disposed on upper surface side and lower surface side of the continuous paper (for example, see Japanese Patent Application Laid Open Publication No. H2-103076). According to the technique described in Japanese Patent Application Laid Open Publication No. H2-103076, the burn of normal paper and deformation of artificial paper can be prevented by securing a sufficient distance to separate the heating roller away.

However, the separation distance of the heating roller is normally limited to approximately 2 to 3 mm in order to prevent the apparatus from getting larger, and thus, this degree of separation amount was insufficient to prevent the influence on sheets (especially, to prevent deformation of artificial paper).

SUMMARY OF THE INVENTION

An object of the present invention, which has been made in consideration of the above problems, is to provide an image forming apparatus which can minimize a wasted portion having no image formed when the fixing temperature is decreased and can reduce the bad influence of heat on continuous paper after image formation on the continuous paper.

In order to achieve one of the above objects, according to one aspect of the present invention, there is provided an image forming apparatus that performs image formation on continuous paper having a toner image formed thereon by making the continuous paper pass through a nip section to fix the toner image to the continuous paper, the nip section being formed by heating at least one of a pair of fixing members and pressure-contacting the fixing members with each other, the apparatus including: a conveyance section which conveys the continuous paper; a blowing section which blows air to the heated fixing member; a pressure-contact separation section which switches the pair of fixing members between a pressure-contacted state that the fixing members are pressure-contacted with each other and a separated state that the fixing members are separated from each other; and a control section which, after the image formation is finished, stops heating of the fixing member, separates the pair of fixing members with the pressure-contact separation section and blows the air to the heated fixing member with the blowing section.

Preferably, in the image forming apparatus, the control section stops conveyance of the continuous paper by the conveyance section after the image formation is finished.

Preferably, in the image forming apparatus, the blowing section blows the air from upstream in a conveyance direction with respect to the heated fixing member.

Preferably, the image forming apparatus further includes a temperature detecting section which detects a temperature of the heated fixing member, and the control section stops blowing of the air by the blowing section when the control section determines that the temperature detected by the temperature detecting section is equal to or less than a first temperature.

Preferably, in the image forming apparatus, the control section sets the first temperature based on a sheet type of the continuous paper.

Preferably, in the image forming apparatus, the control section stops conveyance of the continuous paper by the conveyance section when the control section determines that the temperature detected by the temperature detecting section is equal to or less than a second temperature which is higher than the first temperature.

Preferably, the image forming apparatus further includes an exhaust fan which is disposed downstream in a conveyance direction with respect to the heated fixing member and ejects the air blown to the heated fixing member by the blowing section outside the image forming apparatus.

Preferably, in the image forming apparatus, the blowing section includes: a fan which generates the air; a duct which has a first air outlet disposed downstream in a conveyance direction with respect to the heated fixing member so as to face the heated fixing member and a second air outlet disposed upstream in the conveyance direction with respect to the heated fixing member so as to face the heated fixing member; and a switching section which switches a blowing destination of the air generated by the fan to the first air outlet or the second air outlet, and the control section controls the switching section to switch the blowing destination of the air generated by the fan from the first air outlet to the second air outlet after the image formation is finished.

Preferably, in the image forming apparatus, the pair of fixing members includes a heating roller, a pair of rollers forming the nip section and a heating belt tensioned by the heating roller and one of the pair of rollers.

Preferably, in the image forming apparatus, the pressure-contact separation section separates the pair of fixing members for a predetermined distance or more when the pressure-contact separation section switches the pair of fixing members to the separated state.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of the present invention will be described with reference to the drawings. In the embodiment, a color image forming apparatus is described as an example; however, the present invention is not limited to this, and can also be applied to a monochrome image forming apparatus, for example.

First Embodiment

Figure 1:
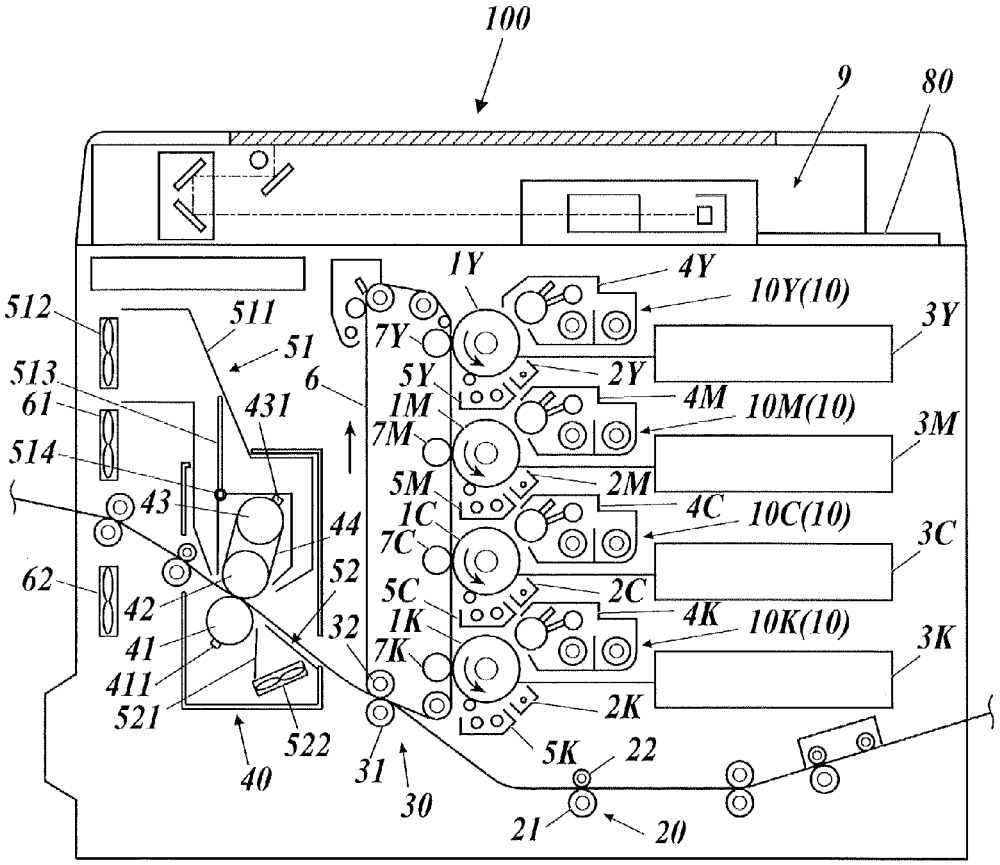
FIG. 1 is a view showing a schematic configuration of an image forming apparatus according to a first embodiment.
Figure 2:
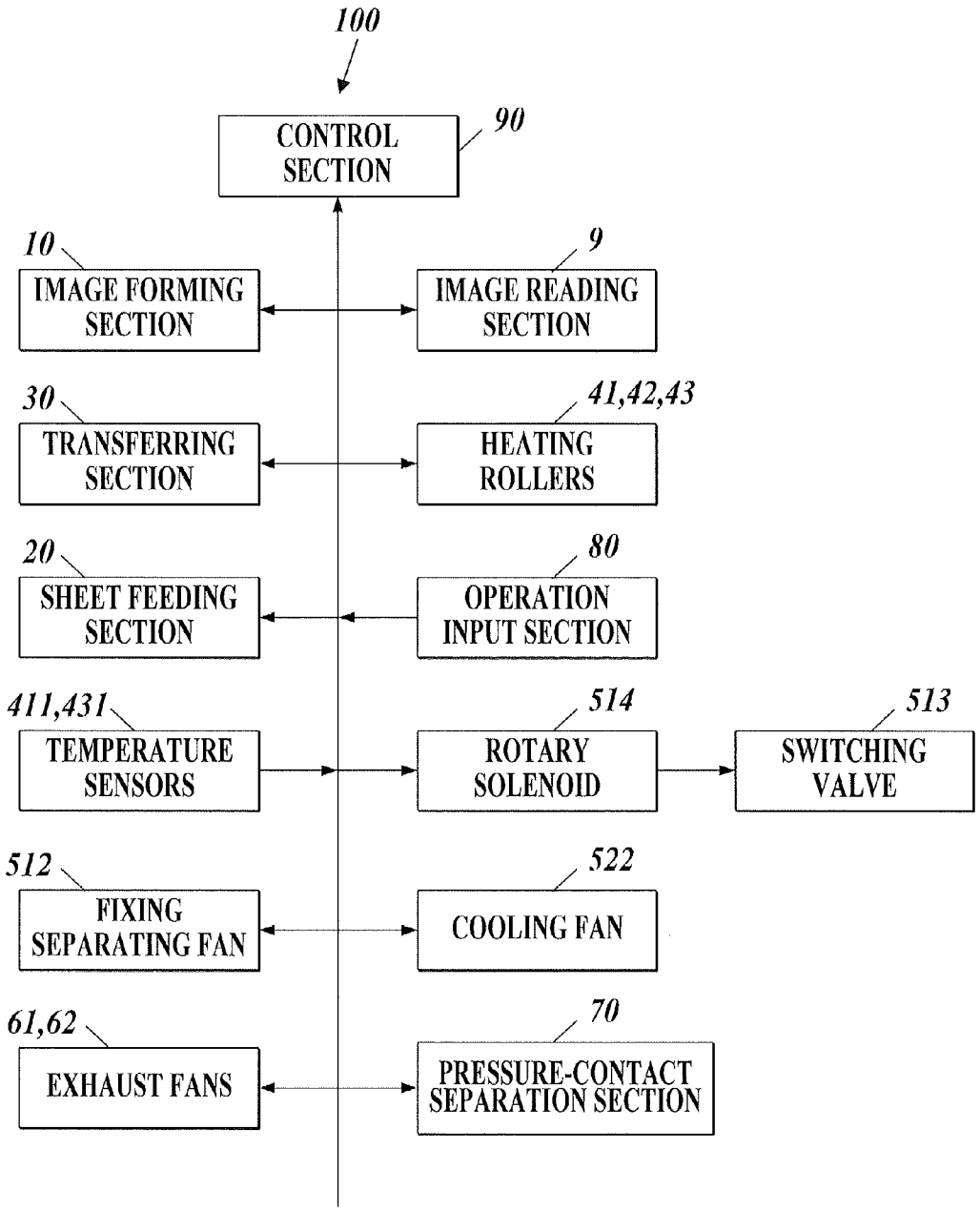
FIG. 2 is a block diagram showing a control structure of the image forming apparatus according to the first embodiment.
Figure 3:
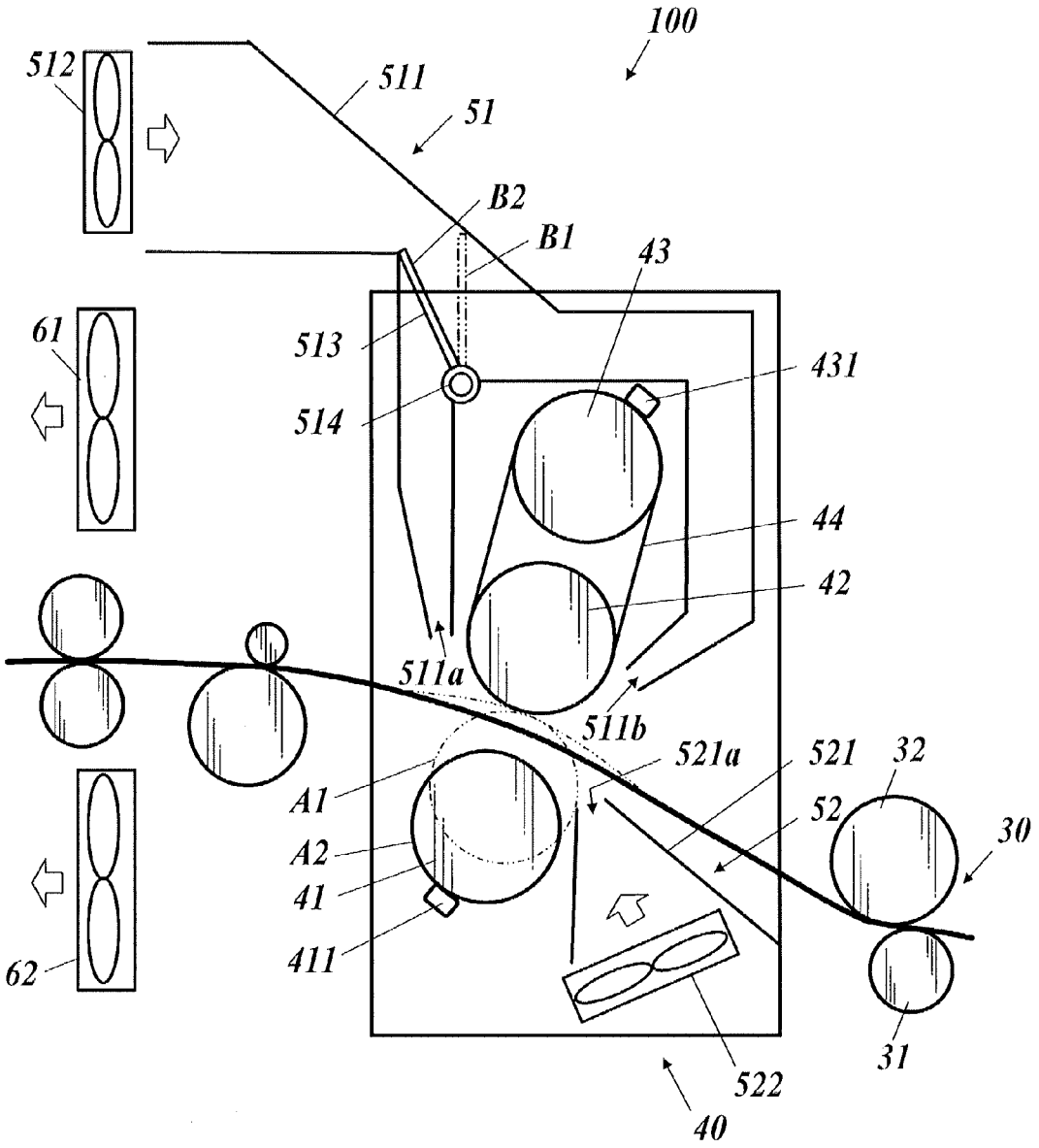
FIG. 3 is an enlarged view around a fixing section of the image forming apparatus according to the first embodiment.

As shown in FIGS. 1 to 3, the image forming apparatus 100 according to the first embodiment is also called a tandem color image forming apparatus and forms color images with four sets of image forming section 10. The image forming apparatus 100 performs electrographic image processing to form an image on a sheet based on image data. The image forming apparatus 100 includes an image reading section 9, a sheet feeding section 20, the image forming section 10, a transferring section 30, a fixing section 40, blowing sections 51 and 52, exhaust fans 61 and 62, an operation input section 80, a control section 90 (see FIG. 2), and such like. The image forming apparatus 100 is configured to be able to perform image formation on continuous paper. The continuous paper is a sheet of paper which is longer than a predetermined value in the longer direction, and generally, the length thereof in the longer direction is several meters to tens of meters.

The image reading section 9 scans and exposes an image of a document placed on a document holder with optical system of scanning exposure apparatus, reads the image into a line image sensor, performs photoelectric conversion and outputs an image information signal. With respect to the output image signal, an image processing section (not shown in the drawings) performs analog processing, A/D conversion, shading correction, image compression processing and such like, and the image signal is input to an optical writing section 3 in each image forming section 10.

The operation input section 80 is provided around the image reading section 9. The user can perform setting for image formation, for example, setting of sheet size and the number of copies to be printed, via the operation input section 80.

The sheet feeding section 20, the image forming section 10, an intermediate transfer belt 6, a transferring section 30, the fixing section 40 and such like are disposed below the image reading section 9.

As the image forming section 10, there are provided a total of four image forming sections that are an image forming section 10Y which forms an image in yellow (Y), an image forming section 10M which forms an image in magenta (M), an image forming section 10C which forms an image in cyan (C) and an image forming section 10K which forms an image in black (K).

The image forming section 10Y includes a photoreceptor drum 1Y, a charging section 2Y which is disposed around the photoreceptor drum 1Y, an optical writing section 3Y, a developing section 4Y, and a photoreceptor drum cleaning section 5Y. Similarly, image forming sections 10M, 10C and 10K respectively include photoreceptor drums 1M, 1C and 1K, charging sections 2M, 2C and 2K, optical writing sections 3M, 3C and 3K, developing sections 4M, 4C and 4K, and photoreceptor drum cleaning sections 5M, 5C and 5K. The photoreceptor drums 1Y, 1M, 1C and 1K, charging sections 2Y, 2M, 2C and 2K, optical writing sections 3Y, 3M, 3C and 3K, developing sections 4Y, 4M, 4C and 4K, and photoreceptor drum cleaning sections 5Y, 5M, 5C and 5K of the image forming sections 10Y, 10M, 10C and 10K are configured to have functions similar to each other. Accordingly, the sections are described without providing reference numerals Y, M, C and K except in a case where the sections are especially distinguished.

The image forming section 10 writes an image information signal into the photoreceptor drum 1 with the optical writing section 3, and forms an electrostatic latent image based on the image information signal on the photoreceptor drum 1. The electrostatic latent image is developed by the developing section 4 and a toner image which is a visible image is formed on the photoreceptor drum 1.

The intermediate transfer belt 6 is an endless belt which is tensioned by a plurality of rollers and supported to be runnable. The toner images in respective colors formed by the image forming sections 10Y, 10M, 10C and 10K are sequentially transferred onto the intermediate transfer belt 6 which is operated by primary transferring sections 7Y, 7M, 7C and 7K, the color image (toner image) in which the color (Y, M, C and K) layers are superposed on each other is primary transferred onto the intermediate transfer belt 6.

The sheet feeding section 20 including a feed roller 21 and a counter roller 22 conveys a sheet supplied from outside of the image forming apparatus 100 and feeds the sheet to the transferring section 30.

The transferring section 30 includes a transfer roller 31 and a transfer counter roller 32.

The transfer roller 31 is disposed so as to contact the transfer counter roller 32 via the intermediate transfer belt 6. By the sheet passing through a transfer nip formed between the transfer roller 31 and the transfer counter roller 32, the toner image on the transfer belt 6 is secondary transferred onto the sheet.

The fixing section 40 is disposed to the sheet ejection side in the transfer roller 31. As shown in FIGS. 1 and 3, the fixing section 40 is configured by including a heating roller 41 disposed to the lower surface side of sheet, heating rollers 42 and 43 disposed to the upper surface side and a heating belt 44. The heating roller 41 forms one of the pair of fixing members of the present invention, and the heating rollers 42 and 43 and heating belt 44 form the other of the pair of fixing members of the present invention. The fixing section 40 makes the sheet pass through the nip section formed by heating and pressure-contacting the pair of fixing members with each other, thereby heats and presses the sheet to fix the transferred toner images to the sheet, and conveys the sheet downstream in the conveyance direction.

That is, the feed roller 21 and the counter roller 22 in the sheet feeding section 20, the transfer roller 31 and the transfer counter roller 32 in the transferring section 30, and the heating rollers 41 and 42 in the fixing section 40 form a conveyance section of the present invention.

The heating belt 44 is tensioned by the heating rollers 42 and 43. The heating roller 43 includes a high-power heater therein, rotates in a forward direction with respect to sheet conveyance direction, and heats the heating roller 42 via the heating belt 44. The heating roller 42 rotates in a forward direction with respect to the sheet conveyance direction and heats and presses the fixed surface of the conveyed sheet via the heating belt 44. The heating roller 41 includes a high-power heater therein similarly to the heating roller 43, rotates in a forward direction with respect to sheet conveyance direction, and heats and presses the non-fixed surface of the conveyed sheet.

The surfaces of the heating rollers 41 and 43 are provided with temperature sensors 411 and 431 as a temperature detecting section which detects respective temperatures.

As shown in FIG. 3, the heating roller 41 can retreat from a fixing position A1 to a retreat position A2 lower than the fixing position A1 where the heating roller 41 is located at fixing processing. The heating roller 41 is moved by a pressure-contact separation section 70 (see FIG. 2). The detailed configuration and operation of the pressure-contact separation section 70 can use conventional known arts (for example, Japanese Patent Application Laid Open Publication No. H2-103076), for example, and thus, the detailed description is omitted. The heating roller 41 is held by an arm which is connected via an extension spring to a lever vertically rocked by cam rotation, and the heating roller 41 is movable to the fixing position A1 and the retreat position A2 by the cam rotation.

That is, the pressure-contact separation section 70 switches the pair of fixing members (heating rollers 42 and 43) between a pressure-contacted state that the fixing members are pressure-contacted with each other and a separated state that the fixing members are separated from each other.

As shown in FIGS. 1 and 3, the blowing section 51 is configured by including a duct 511, a fixing separating fan 512, a switching valve 513 and a rotary solenoid 514. The blowing section 51 blows separating air for separating the heating roller 42 from the sheet through an air outlet (first air outlet) 511*a* of the duct 511 and blows cooling air (air) for cooling the heating roller 42 and the sheet through an air outlet (second air outlet) 511*b* by the rotation drive of the fixing separating fan 512. The air outlet 511*a* is disposed downstream in the conveyance direction with respect to the heating roller 42 so as to face the heating roller 42 and the sheet. The air outlet 511*b* is disposed upstream in the conveyance direction with respect to the heating roller 42 so as to face the heating roller 42 and the sheet.

That is, the blowing section 51 blows air between the sheet and the heating roller 42 to cool the heating roller 42. The blowing section 51 blows air from upstream in the conveyance direction with respect to the heating roller 42.

As shown in FIG. 3, by the control of the rotary solenoid 514 by the control section 90, the blowing section 51 can switch the switching valve 513 between a fixing separating position B1 that the separating air is blown through the air outlet 511*a* at the fixing processing and a cooling position B2 that the cooling air is blown through the air outlet 511*b* after the fixing processing.

That is, the switching valve 513 and the rotary solenoid 514 function as a switching section which switches the destination to blow the air generated by the fixing separating fan 512 between the air outlet 511*a* and the air outlet 511*b*.

The blowing section 52 is configured by including a duct 521 and a cooling fan 522, and blows cooling air for cooling the heating roller 41 and the sheet through the air outlet 521*a* of the duct 521 by the rotation drive of the cooling fan 522. The air outlet 521*a* is disposed upstream in the conveyance direction with respect to the heating roller 41 so as to face the heating roller 41 and the sheet.

That is, the blowing section 52 blows air between the sheet and the heating roller 41 to cool the heating roller 41. The blowing section 52 blows air from upstream in the conveyance direction with respect to the heating roller 41.

The exhaust fans 61 and 62 are disposed downstream in the conveyance direction with respect to the fixing section 40 (heating rollers 41 and 42), and exhaust, outside the apparatus, a cooling heat or such like generated when the heating roller 42 and the sheet are cooled by the blowing sections 51 and 52. The exhaust fan 61 is disposed upper than the conveyed sheet, that is, to the side where the heating roller 42 is disposed. The exhaust fan 62 is disposed lower than the conveyed sheet, that is, to the side where the heating roller 41 is disposed.

As shown in FIG. 2, the above sections of the image forming apparatus 100 are connected to the control section 90, and are appropriately controlled by the control section 90. The control section 90 is configured by including a CPU, a RAM and a ROM not shown in the drawings, and performs various operations in accordance with various processing programs for the image forming apparatus 100.

Next, operations of the image forming apparatus 100 according to the first embodiment will be described with reference to the flowchart in FIG. 4. Here, a case of using continuous paper as a sheet will be described as an example.

First, the control section 90 determines whether image formation on the sheet (continuous paper) is finished (step S101).

If it is determined that the image formation is finished (step S101: YES), the processing shifts to the next step S2.

On the other hand, if it is not determined that the image formation is finished (step S101: NO), the processing of step S101 is repeated until the image formation is finished.

Next, the control section 90 ends heat retention of the heating rollers 41 to 43 (step S102). Specifically, the control section 90 ends the heat retention of the heating rollers 41 to 43 by interrupting the electric conduction to the respective heaters for heating the heating rollers 41 and 43.

Next, the control section 90 controls the sheet feeding section 20 and such like to stop conveyance of the continuous paper (step S103).

The control section 90 moves away the heating roller 41 downward (step S104). Specifically, the control section 90 controls the pressure-contact separation section 70 to move the heating roller 41 from the fixing position A1 to the retreat position A2, and thereby moves the heating roller 41 downward.

Here, preferably, the pressure-contact separation section 70 separates the pair of fixing members (heating rollers 41 and 42) from each other for a predetermined distance or more when switching to the separated state. The predetermined distance is, for example, a distance that the heat added to the continuous paper has a temperature not deforming artificial paper even when the heat of the temperature is continuously added to the continuous paper.

Next, the control section 90 rotates the cooling fan 522 (step S105). Specifically, the control section 90 rotates the cooling fan 522 by applying electric current to the motor for rotating the cooling fan 522. Thus, cooling air is blown to the heating roller 41 and the sheet from the air outlet 521*a*.

The control section 90 switches the switching valve 513 to the cooling position B2 (step S106). Specifically, the control section 90 controls the rotary solenoid 514 to switch the switching valve 513 from the fixing separating position B1 to the cooling position B2. Since the fixing separating fan 512 is continuously rotated from when the image formation is performed, cooling air is blown to the heating roller 42 and the sheet from the air outlet 511*b*.

That is, the control section 90 functions as a control section which, after the image formation is finished, stops heating of the heating rollers 41 to 43, separates the pair of fixing members from each other with the pressure-contact separation section 70 and blows air to the heated fixing members with the blowing sections 51 and 52.

Next, the control section 90 determines whether or not each of the temperatures of the heating rollers 41 and 42 is equal to or less than a first temperature (step S107). Specifically, the control section 90 detects the temperatures of heating rollers 41 and 43 with the temperature sensors 411 and 432, respectively, and determines whether each of the temperatures is equal to or less than the first temperature. Here, the first temperature is a temperature which does not deform the artificial paper even if the temperature is continuously added to the artificial paper, that is, the temperature which does not have bad influence on the sheet even if the sheet contacts the heating rollers 41 and 42. The first temperature is 110° C. for the heating roller 42 disposed in the upper side and 90° C. for the heating roller 41 disposed in the lower side, for example. The heating rollers 42 and 41 are different in temperature in order to be able to handle a case where the continuous paper is likely to contact the heating roller 41 such as a case where the cooling fan 522 is stopped, for example. In a state in which the heating roller 41 is moved to the retreat position A2 and the heating rollers 41 and 42 are separated from the sheet, the sheet does not remove heat from the heating roller 42. Thus, the temperature of the heating roller 43 is nearly the same as the temperature of the heating roller 42 heated via the heating belt 44. Accordingly, here, by detecting the temperature of heating roller 43, the temperature of heating roller 42 can be detected.

If it is determined that each of the temperatures of the heating roller 41 and the heating roller 42 is equal to or less than the first temperature (step S107: YES), the processing shifts to step S108.

On the other hand, if it is not determined that the temperatures of the heating roller 41 and the heating roller 42 are equal to or less than the first temperature, that is, if it is determined that at least one of the heating roller 41 and the heating roller 42 is higher than the first temperature (step S107: NO), the processing of step S107 is repeated until the temperatures of the heating roller 41 and the heating roller 42 are equal to or less than the first temperature.

Next, the control section 90 stops the cooling fan 522 and the fixing separating fan 512 (steps S108 and 109). Specifically, the control section 90 stops the cooling fan 522 and the fixing separating fan 512 by interrupting the electric conduct to respective motors rotating the cooling fan 522 and the fixing separating fan 512.

The control section 90 switches the switching valve 513 to the fixing separating position B1 (step S110). Specifically, the control section 90 controls the rotary solenoid 514 to switch the switching valve 513 from the cooling position B2 to the fixing separating position B1. Thus, separation air is blown to the heating roller 42 and the sheet from air outlet 511*a* at the next fixing processing.

The control section 90 starts temperature adjustment control of the heating rollers 41 to 43 (step S111). Specifically, the control section 90 starts the temperature adjustment control for adjusting the heating rollers 41 to 43 to a predetermined idling temperature by applying electric current to the respective heaters heating the heating rollers 41 and 43.

The processing of steps S102 and 103 can be performed in a random order or simultaneously. In either case, the sheet conveyance is stopped (step S103) instantly at the end of the image formation (step S101).

The processing of steps S104 to 106 can be performed in a random order or simultaneously. Similarly, the processing of steps S108 to S110 can also be performed in a random order or simultaneously.

As described above, the image forming apparatus 100 according to the first embodiment includes the conveyance section (sheet feeding section 20, transferring section 30 and fixing section 40) which conveys the continuous paper, the blowing sections 51 and 52 which blow air to heated fixing members (heating rollers 41 and 42), the pressure-contact separation section 70 which switches the pair of fixing members between the pressure-contacted state that the pair of fixing members are pressure-contacted with each other and the separated state that the fixing members are separated from each other, and the control section 90 which, after the image formation is finished, stops the heating of fixing members, separates the pair of fixing members from each other with the pressure-contact separation section 70 and blows air to the heated fixing members with the blowing sections 51 and 52.

Accordingly, according to the image forming apparatus 100 in the first embodiment, cooling work can be performed in a state in which the heating rollers 41 and 42 are separated from the continuous sheet, and thus, the working time can be shortened. Therefore, it is possible to reduce the bad influence of heat on the continuous paper while minimizing the wasted part on which image formation is not performed when the fixing temperature is lowered.

In the image forming apparatus 100 according to the first embodiment, when the pressure-contact separation section 70 switches to the separated state, the pair of fixing members are separated for a predetermined distance or more, and thereby, the temperature of heat added to the continuous paper can be lowered. Thus, it is possible to reduce the bad influence of heat on the continuous paper and shorten the time required for the cooling work.

In the image forming apparatus 100 according to the first embodiment, the control section 90 stops conveyance of continuous paper by the conveyance section after the image formation is finished. Thus, the waste feeding of continuous paper when the image formation is not performed is eliminated, and the wasted part on which image is not formed can be shortened as much as possible.

In the image forming apparatus 100 according to the first embodiment, the blowing sections 51 and 52 blow air from upstream in the conveyance direction with respect to the heated fixing members. Thus, the cooling heat is not transmitted to the upstream in the conveyance direction, for example, to the transferring section 30 side, and thus, it is possible to avoid the shift of printing timing and inconveniences such as toner fixation.

The image forming apparatus 100 according to the first embodiment further includes the temperature detecting section (temperature sensors 411 and 431) which detects the temperatures of the heated fixing members, and the control section 90 stops the air blowing by the blowing sections 51 and 52 when it is determined that the temperatures detected by the temperature detecting section are equal to or less than the first temperature. Thus, unnecessary cooling can be avoided and the time required for cooling work can be shortened.

The image forming apparatus 100 according to the first embodiment further includes exhaust fans 61 and 62 which are disposed downstream in the conveyance direction with respect to the heated fixing members and exhaust cooling heat outside the apparatus, the cooling heat being generated when the heating rollers 41 and 42 are cooled by the blowing sections 51 and 52. Thus, the raise in temperature inside the apparatus due to the cooling heat can be prevented, and it is possible to achieve the stable operation of apparatus.

In the image forming apparatus 100 according to the first embodiment, the blowing section 51 further includes the duct 511 having a fan (fixing separating fan 512) which generates air, a first air outlet (air outlet 511*a*) which is disposed downstream in the conveyance direction with respect to the heated fixing member (heating roller 42) so as to face the heating roller 42 and a second air outlet (air outlet 511*b*) which is disposed upstream in the conveyance direction with respect to the heating roller 42 so as to face the heating roller 42, and a switching section (switching valve 513 and rotary solenoid 514) which switches the destination to blow the air generated by the fan to either one of the first air outlet and the second air outlet. The control section 90 controls the switching section so that the destination to blow the air generated by the fan is switched from the first air outlet to the second air outlet after the image formation is finished.

Accordingly, according to the image forming apparatus 100 in the first embodiment, the cooling processing can be executed using the fixing separating fan 512 which is originally equipped to the apparatus without separately attaching a cooling fan. Thus, it is possible to prevent the cost rise.

The image forming apparatus 100 according to the first embodiment includes the heating roller 43, the pair of rollers (heating rollers 41 and 42) forming the nip section, and the heating belt 44 which is tensioned by the heating roller 43 and either one of the pair of rollers (heating rollers 42). Thus, the perimeter of the heating roller 42 is lengthened to increase the amount of heat which can be held by the heating roller 42, the number of ON/OFF switching of the heater which is built in the heating roller 43 and heats the heating roller 42 is reduced, and it is possible to prevent the decrease in heater life.

Second Embodiment

An image forming apparatus 100A according to the second embodiment is different from the image forming apparatus 100 according to the first embodiment in that a blowing section 53 is provided instead of the blowing section 51. In order to simplify the explanation, the detailed description for the same configuration as that of the first embodiment is omitted by providing the same reference numerals.

Figure 5:
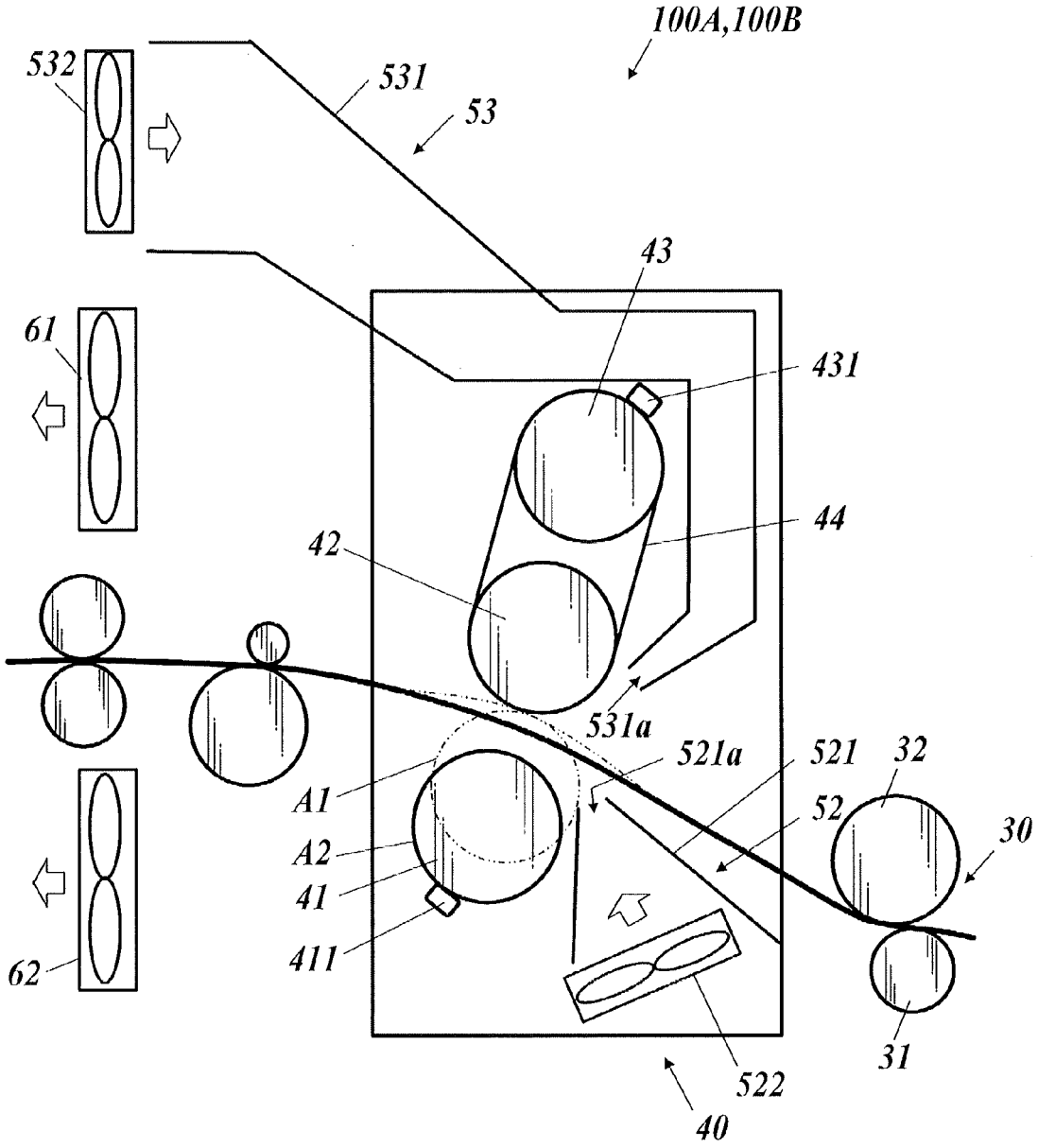
FIG. 5 is an enlarged view around a fixing section of an image forming apparatus according to a second embodiment.

Specifically, the blowing section 53 in the image forming apparatus 100A according to the second embodiment is configured by including a duct 531 and a cooling fan 532 as shown in FIG. 5, and by the rotation drive of the cooling fan 532, cooling air for cooling the heating roller 42 and the sheet is blown through the air outlet 531*a* of the duct 531. The air outlet 531*a* is disposed upstream in the conveyance direction with respect to the heating roller 42 so as to face the heating roller 42 and the sheet.

Next, operations of the image forming apparatus 100A according to the second embodiment will be described with reference to the flowchart in FIG. 6.

Figure 4:
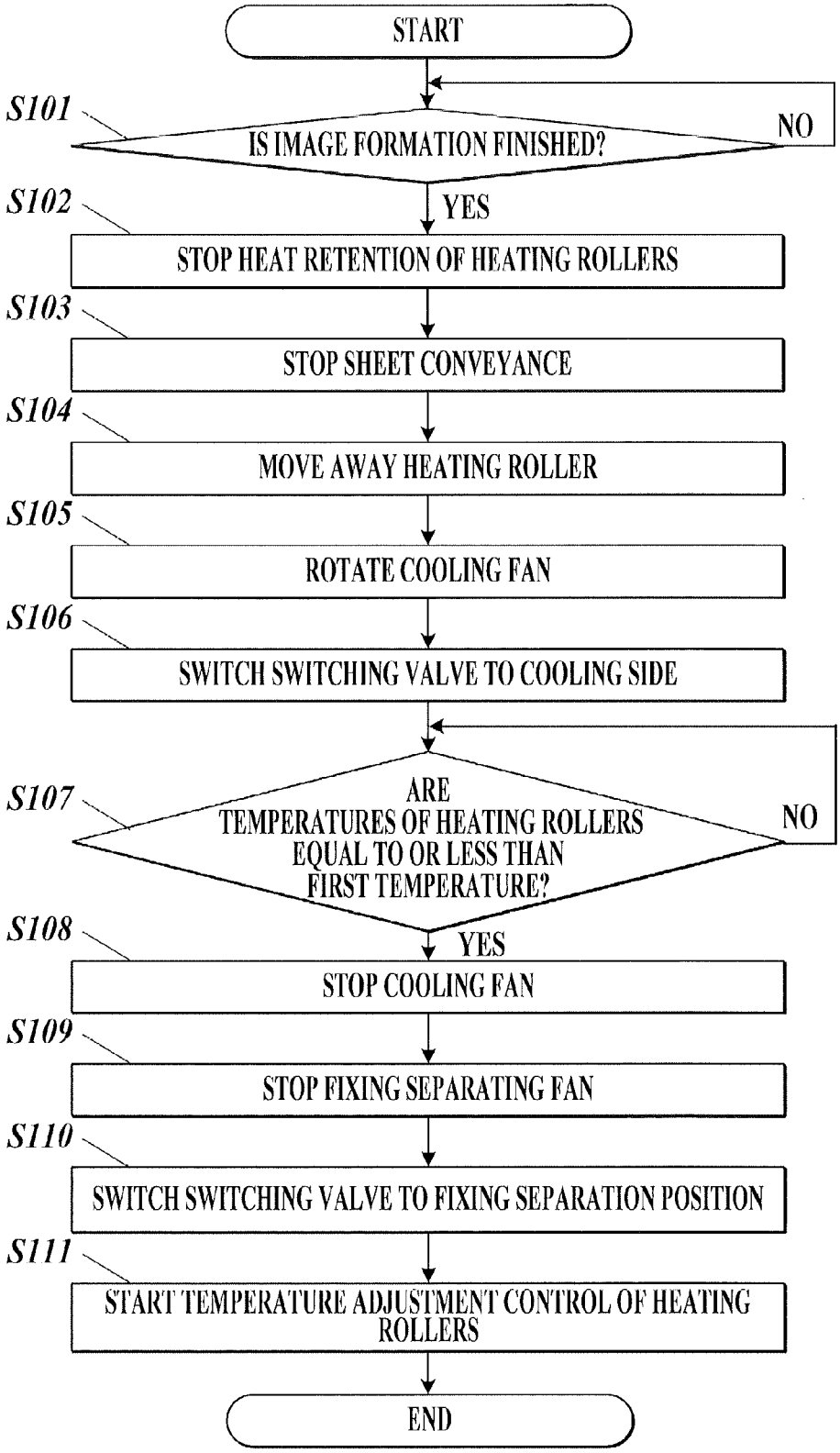
FIG. 4 is a flowchart showing an operation of the image forming apparatus according to the first embodiment.

Since the processing in steps S201 to S204 is similar to that of steps S101 to S104 in FIG. 4 showing operations of image forming apparatus 100 according to the first embodiment, the explanation thereof is omitted.

Next, the control section 90 rotates the cooling fan 522 and the cooling fan 532 (step S205). Specifically, the control section 90 rotates the cooling fans 522 and 532 by applying electric current to the respective motors for rotating the cooling fans 522 and 532. Thus, cooling air is blown to the heating roller 41 and the sheet from the air outlet 521*a*, and cooling air is blown to the heating roller 42 and the sheet from the air outlet 531*a*.

The next processing in step S206 is similar to that of step S107 in FIG. 4, and thus, the explanation thereof is omitted.

Next, the control section 90 stops the cooling fans 522 and 532 (step S207). Specifically, the control section 90 stops the cooling fans 522 and 532 by interrupting the electric conduction to the respective motors for rotating the cooling fans 522 and 532.

The next processing in step S208 is similar to that of step S111 in FIG. 4, and thus, the explanation thereof is omitted.

That is, the operations of image forming apparatus 100A according to the second embodiment are different from the operations of image forming apparatus 100 according to the first embodiment only in that the processing of steps S106, S109 and S110 in FIG. 4 according to the operation of fixing separating fan 512 and the switching valve 513 is not performed.

As described above, according to the image forming apparatus 100A in the second embodiment, even an apparatus not including the fixing separating fan 512 in advance can obtain the same effect as that of the image forming apparatus 100 according to the first embodiment by including the cooling fan 532 instead. Also, it is possible to obtain the effect with a simplified and inexpensive configuration since the switching valve 513 and the rotary solenoid 514 are not necessary.

Third Embodiment

An image forming apparatus 100B according to the third embodiment is different from the image forming apparatus 100A according to the second embodiment in operations. Since the configuration of the image forming apparatus 100B according to the third embodiment is similar to that of the second embodiment, the detailed description is omitted by providing the same reference numerals.

Figure 7:
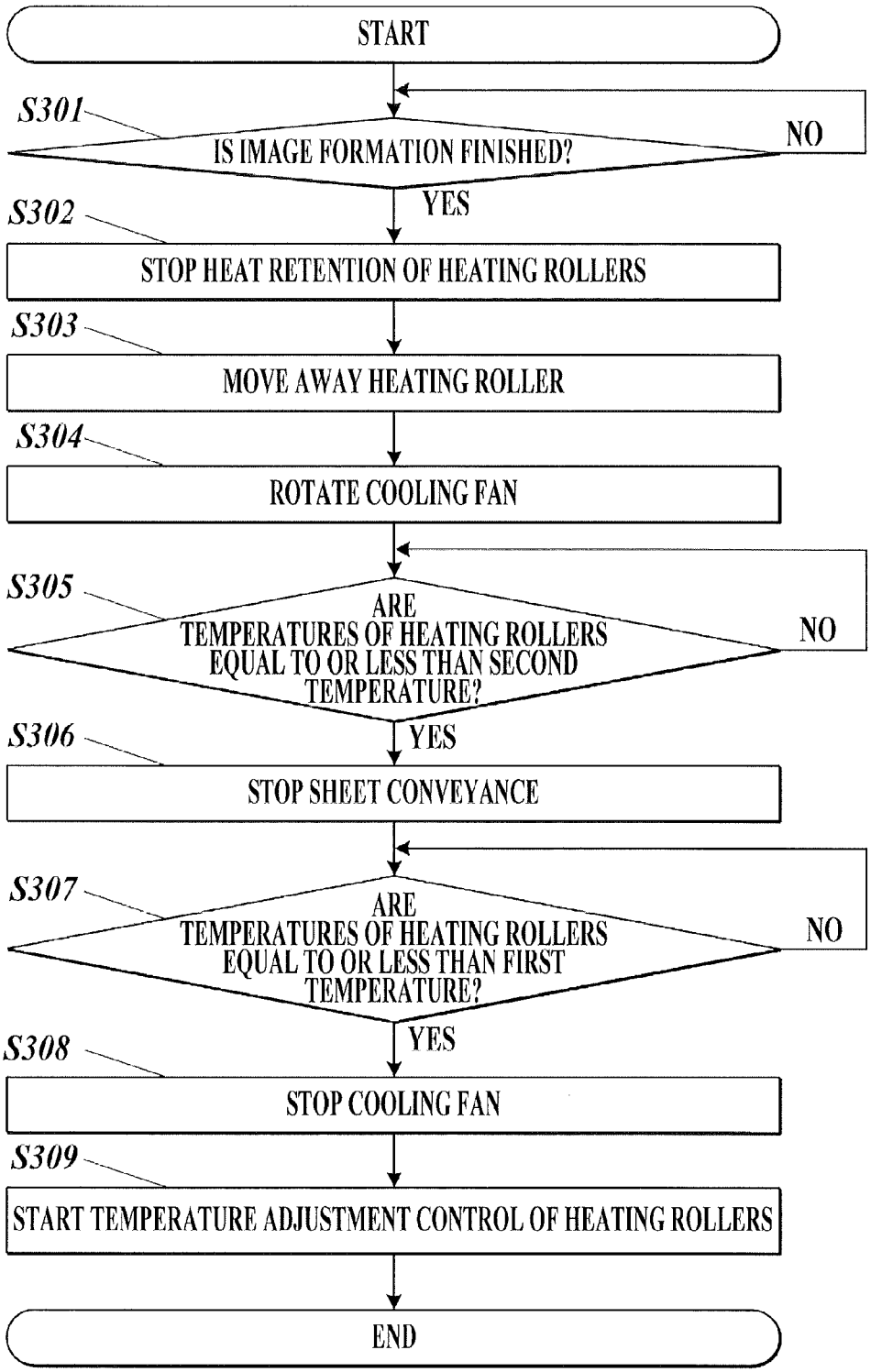
FIG. 7 is a flowchart showing an operation of an image forming apparatus according to a third embodiment.

Operations of the image forming apparatus 100B according to the third embodiment will be described with reference to the flowchart in FIG. 7.

Figure 6:
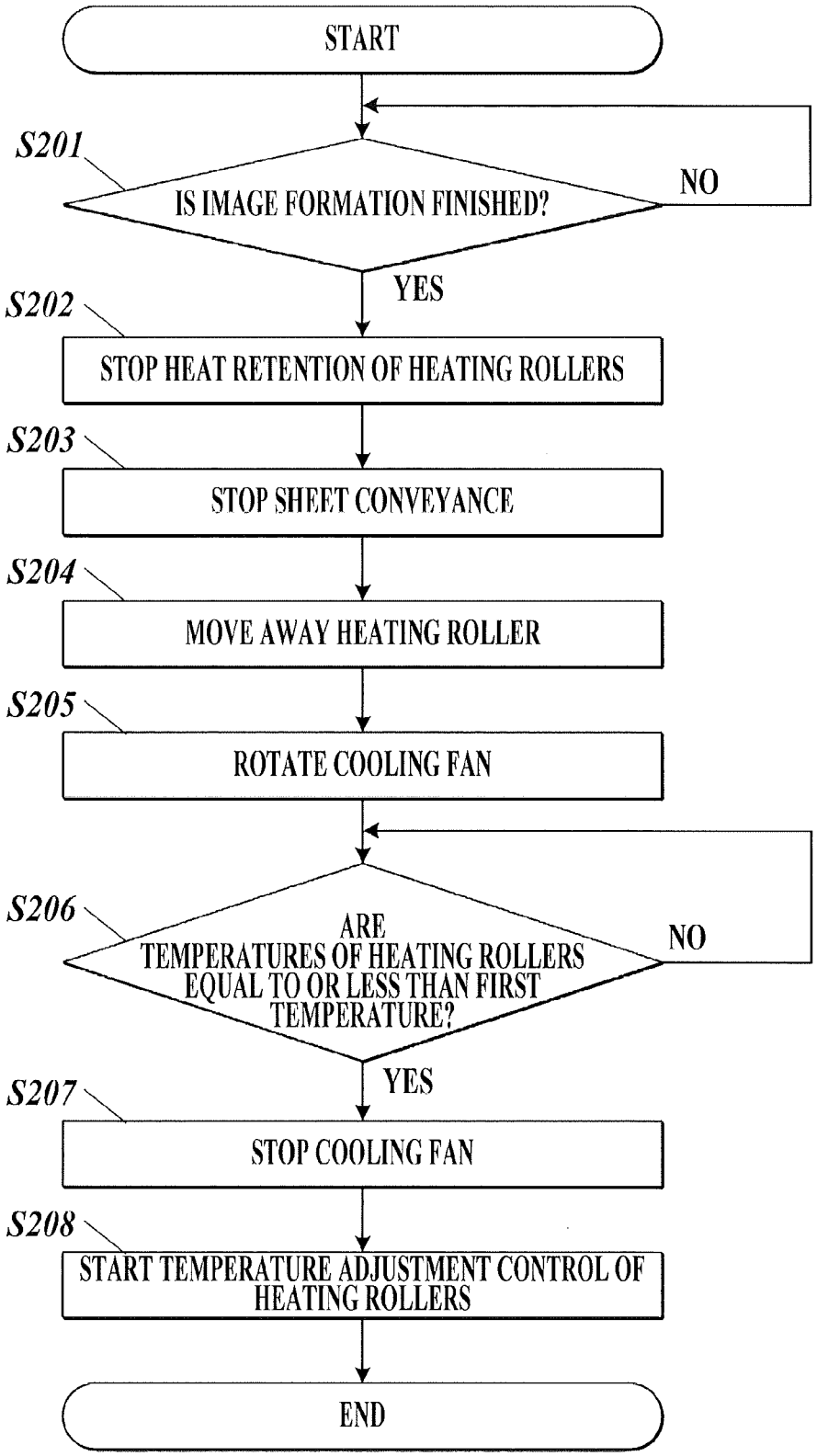
FIG. 6 is a flowchart showing an operation of the image forming apparatus according to the second embodiment.

Since the processing in steps S301 and 302 is similar to that of steps S201 and S202 in FIG. 6 showing the operations of image forming apparatus 100A according to the second embodiment, the explanation thereof is omitted.

Since the processing in steps S303 and S304 is similar to that of steps S204 and S205 in FIG. 6, the explanation thereof is omitted.

Next, the control section 90 determines whether the temperatures of heating rollers 41 and 42 are equal to or less than a second temperature (step S305). Specifically, the control section 90 detects the temperatures of heating rollers 41 and 43 with the temperature sensors 411 and 431, respectively, and determines whether the temperatures are equal to or less than a second temperature. Here, the second temperature is a temperature which can avoid the bad influence on the sheet merely by the cooling processing with the blowing sections 53 and 52. More specifically, the second temperature is a temperature that can avoid the bad influence on the sheet by making the sheet not contact the heating rollers 41 and 42 as much as possible even when the sheet conveyance is stopped. That is, if the temperatures of heating rollers 41 and 42 are equal to or less than the second temperature, even when the sheet conveyance is stopped, the bad influence on the sheet can be avoided by moving away the heating roller 41 to avoid, as much as possible, the contact between the sheet and the heating rollers 41 and 42.

If it is determined that the temperatures of heating rollers 41 and 42 are equal to or less than the second temperature (step S305; YES), the processing shifts to the next step S306.

On the other hand, if it is not determined that the temperatures of heating rollers 41 and 42 are equal to or less than the second temperature, that is, at least one of the heating rollers 41 and 42 is higher than the second temperature (step S305; NO), the processing of step S305 is repeated until the temperatures become equal to or less than the second temperature.

The next processing in step S306 and the processing in steps S307 to S309 are respectively similar to the processing in step S203 in FIG. 6 and the processing in steps S206 to S208 in FIG. 6, and thus, the explanation thereof is omitted.

That is, the operations of the image forming apparatus 100B according to the third embodiment are different from the operations of image forming apparatus 100A according to the second embodiment in the timing for stopping the conveyance of continuous paper. Specifically, the control section 90 stops the conveyance of continuous paper not after the image formation but at the timing when the temperatures of the heating rollers 41 and 42 become equal to or less than the second temperature by the cooling processing (see step S304) by the blowing sections 53 and 52.

As described above, according to the image forming apparatus 100B in the third embodiment, the conveyance stop section stops the conveyance of continuous paper by the conveyance section when it is determined that the temperatures detected by the temperature detecting section are equal to or less than the second temperature which is higher than the first temperature. Thus, in a case where the bad influence of heating on continuous paper cannot be avoided only by the cooling processing of continuous paper by the blowing sections 53 and 52 after stopping the conveyance of continuous paper, for example, a case where the fixing temperature is high as infixing processing on thick paper and such like, the conveyance of continuous paper is stopped after cooling to the temperature that the bad influence on continuous paper can be avoided only by the cooling processing by the blowing sections 53 and 52. Thus, it is possible to surely reduce the bad influence of heating on continuous paper while minimizing the wasted part on which image is not formed.

The embodiments according to the present invention have been specifically described above; however, the present invention is not limited to the above embodiments and various changes can be made within the scope of the invention.

For example, the above embodiments have been described by illustrating a case where the cooling by the blowing sections 51 to 53 is stopped regardless of the sheet type when the temperatures of heating rollers 41 to 43 are equal to or less than the first temperature; however, the present invention is not limited to this. That is, the control section may set the first temperature on the basis of the sheet type of the continuous paper. For example, in a case of artificial paper, the first temperature of heating roller 42 disposed in the upper side is set to be 110° C. and the first temperature of heating roller 41 disposed in the lower side is set to be 90° C. In a case of normal paper, since the paper is less influenced by heating compared to the artificial paper, the first temperatures may be set to be high by setting the first temperature of heating roller 42 disposed in the upper side to be 140° C. and setting the first temperature of the heating roller 41 disposed in the lower side to be 110° C. to shorten the cooling time. Thus, processing corresponding to the type of paper is possible and it is possible to shorten the time required for the cooling work by avoiding unnecessary cooling.

Similarly, the second temperature may also be set on the basis of the sheet type of the continuous paper.

In the above embodiments, when cooling the heating rollers, air is blown from upstream side to the downstream side in conveyance direction; however, the present invention is not limited to this. For example, if a filter is provided to block between the fixing section 40 and the transferring section 30, it is possible to achieve the configuration of blowing air from downstream side to the upstream side in the conveyance direction. In this case, the separation air of the fixing separating fan 512 can be directly used as the cooling air, and thus, the switching valve 513 and the rotary solenoid 514 are not necessary and the effect can be obtained by a simple configuration.

In the above embodiments, the exhaust fans 61 and 62 are provided in order to eject, outside the apparatus, the cooling heat and such like generated when the blowing sections 51 to 53 cool the heating rollers 41 and 42 and the sheet; however, the present invention is not limited to this. That is, the present invention may not include the exhaust fans 61 and 62.

In the above embodiments, the fixing section 40 includes the heating roller 41 disposed in the lower surface side of sheet, the heating rollers 42 and 43 disposed in the upper surface side and the heating belt 44; however, the present invention is not limited to this. For example, the fixing section 40 may include only the pair of heating rollers 41 and 42.

Also, the fixing section 40 may include the heating roller 42 disposed in the upper surface side of sheet and a fixing roller having no heating function and disposed in the lower surface side of sheet so as to provide a blowing section (such as the blowing section 51) only in the heating roller 42 side, that is, the upper surface side of sheet.

In the embodiments, the pressure-contact separation section 70 makes the heating roller 41 disposed in the lower surface side of sheet retreat; however, the present invention is not limited to this. For example, the heating roller 42 disposed in the upper surface side of sheet may retreat. Both of the heating roller 41 disposed in the lower surface side of sheet and the heating roller 42 disposed in the upper surface side may retreat.

The other detailed configurations and detailed operations of the units forming the image forming apparatus can also be appropriately changed within the scope of the present invention.

According to one aspect of a preferred embodiment of the present invention, there is provided an image forming apparatus that performs image formation on continuous paper having a toner image formed thereon by making the continuous paper pass through a nip section and fixing the toner image to the continuous paper, the nip section being formed by heating at least one of a pair of fixing members and pressure-contacting the fixing members with each other, the apparatus including: a conveyance section which conveys the continuous paper; a blowing section which blows air to the heated fixing member; a pressure-contact separation section which switches the pair of fixing members between a pressure-contacted state that the fixing members are pressure-contacted with each other and a separated state that the fixing members are separated from each other; and a control section which, after the image formation is finished, stops heating of the fixing member, separates the pair of fixing members with the pressure-contact separation section and blows the air to the heated fixing member with the blowing section.

In this image forming apparatus, it is possible to reduce the bad influence of heating on the continuous paper while minimizing the wasted portion on which image formation is not performed when the fixing temperature is decreased after the image formation is performed on the continuous paper.

The entire disclosure of Japanese Patent Application No. 2014-054401 filed on Mar. 18, 2014 including description, claims, drawings, and abstract are incorporated herein by reference in its entirety.

What is claimed is:

1. An image forming apparatus that performs image formation on continuous paper having a toner image formed thereon by making the continuous paper pass through a nip section to fix the toner image to the continuous paper, the nip section being formed by heating at least one of a pair of fixing members, which is a first fixing member, and pressure-contacting the fixing members with each other, the apparatus comprising:

a conveyance section which conveys the continuous paper;

a blowing section which blows air to the first fixing member;

a pressure-contact separation section which switches the pair of fixing members between a pressure-contacted state that the fixing members are pressure-contacted with each other and a separated state that the fixing members are separated from each other;

a control section which, after the image formation is finished, stops heating of the first fixing member, separates the pair of fixing members with the pressure-contact separation section and blows the air to the first fixing member with the blowing section in a state in which a part of the continuous paper is between the pair of fixing members; and a temperature detecting section which detects a temperature of the first fixing member, wherein the control section stops blowing of the air by the blowing section when the control section determines that the temperature detected by the temperature detecting section is equal to or less than a first temperature, wherein the control section stops conveyance of the continuous paper by the conveyance section when the control section determines that the temperature detected by the temperature detecting section is equal to or less than a second temperature which is higher than the first temperature.

2. The image forming apparatus according to claim 1, wherein the control section stops conveyance of the continuous paper by the conveyance section after the image formation is finished.

3. The image forming apparatus according to claim 1, wherein the blowing section blows the air from upstream in a conveyance direction with respect to the first fixing member.

4. The image forming apparatus according to claim 1, wherein the control section sets the first temperature based on a sheet type of the continuous paper.

5. The image forming apparatus according to claim 1, further comprising an exhaust fan which is disposed downstream in a conveyance direction with respect to the first fixing member and ejects the air blown to the first fixing member by the blowing section outside the image forming apparatus.

6. The image forming apparatus according to claim 1, wherein the blowing section includes:

a fan which generates the air;

a duct which has a first air outlet disposed downstream in a conveyance direction with respect to the first fixing member so as to face the first fixing member and a second air outlet disposed upstream in the conveyance direction with respect to the first fixing member so as to face the first fixing member; and a switching section which switches a blowing destination of the air generated by the fan to the first air outlet or the second air outlet, and the control section controls the switching section to switch the blowing destination of the air generated by the fan from the first air outlet to the second air outlet after the image formation is finished.

7. The image forming apparatus according to claim 1, wherein the pair of fixing members includes a heating roller, a pair of rollers forming the nip section and a heating belt tensioned by the heating roller and one of the pair of rollers.

8. The image forming apparatus according to claim 1, wherein the pressure-contact separation section separates the pair of fixing members for a predetermined distance or more when the pressure-contact separation section switches the pair of fixing members to the separated state.

9. The image forming apparatus according to claim 1, wherein the first fixing member includes a heater.

10. The image forming apparatus according to claim 1, wherein the blowing section further blows air to a second fixing member, and the control section blows air to the second fixing member in addition to the first fixing member with the blowing section after the image formation is finished.

11. The image forming apparatus according to claim 10, wherein the second fixing member includes a heater.

12. The image forming apparatus according to claim 11, wherein the blowing section comprises a plurality of blowers respectively corresponding to the first fixing member and the second fixing member, so that air is blown to each of the first fixing member and the second fixing member by a respective one of the plurality of blowers.

13. The image forming apparatus according to claim 6, wherein the control section controls the switching section so that the blowing destination of the air generated by the fan is the first air outlet when the image formation is performed.

14. An image forming apparatus that performs image formation on continuous paper having a toner image formed thereon by making the continuous paper pass through a nip section to fix the toner image to the continuous paper, the nip section being formed by heating at least one of a pair of fixing members and pressure-contacting the fixing members with each other, the apparatus comprising:

a conveyance section which conveys the continuous paper;

a blowing section which blows air to the heated fixing member;

a pressure-contact separation section which switches the pair of fixing members between a pressure-contacted state that the fixing members are pressure-contacted with each other and a separated state that the fixing members are separated from each other;

a control section which, after the image formation is finished, stops heating of the fixing member, separates the pair of fixing members with the pressure-contact separation section and blows the air to the heated fixing member with the blowing section; and a temperature detecting section which detects a temperature of the heated fixing member, wherein the control section stops blowing of the air by the blowing section when the control section determines that the temperature detected by the temperature detecting section is equal to or less than a first temperature, and wherein the control section stops conveyance of the continuous paper by the conveyance section when the control section determines that the temperature detected by the temperature detecting section is equal to or less than a second temperature which is higher than the first temperature.

* * * * *